US011329375B1

(12) United States Patent
West et al.

(10) Patent No.: US 11,329,375 B1
(45) Date of Patent: May 10, 2022

(54) DIFFERENTIAL QUADRATURE RADIATING ELEMENTS AND FEEDS

(71) Applicant: Rockwell Collins, Inc., Cedar Rapids, IA (US)

(72) Inventors: James B. West, Cedar Rapids, IA (US); Jiwon L. Moran, Marion, IA (US); Russell D. Wyse, Center Point, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 272 days.

(21) Appl. No.: 16/789,908

(22) Filed: Feb. 13, 2020

(51) Int. Cl.

| | |
|---|---|
| ***H01Q 11/08*** | (2006.01) |
| ***H01Q 9/04*** | (2006.01) |
| ***H01Q 3/26*** | (2006.01) |
| ***H01Q 23/00*** | (2006.01) |

(52) U.S. Cl.
CPC ..... *H01Q 3/26* (2013.01); *H01Q 9/0435* (2013.01); *H01Q 9/0492* (2013.01); *H01Q 11/08* (2013.01); *H01Q 23/00* (2013.01)

(58) Field of Classification Search
CPC .. H01Q 3/26; H01Q 3/28; H01Q 3/30; H01Q 3/34; H01Q 5/25; H01Q 9/0435; H01Q 9/0492; H01Q 11/08; H01Q 21/0006; H01Q 23/00
See application file for complete search history.

(56) References Cited

U.S. PATENT DOCUMENTS

| | | | | |
|---|---|---|---|---|
| 5,291,201 | A | 3/1994 | Endler et al. | |
| 5,760,645 | A | 6/1998 | Comte et al. | |
| 5,774,510 | A | 6/1998 | Izzard | |
| 6,147,647 | A | 11/2000 | Tassoudji et al. | |
| 6,760,577 | B2 | 7/2004 | Li | |
| 7,330,501 | B2 | 2/2008 | Trachewsky et al. | |
| 2003/0072389 | A1 | 4/2003 | Li et al. | |
| 2004/0131127 | A1 | 7/2004 | Nadiri et al. | |
| 2005/0159148 | A1 | 7/2005 | Habuka et al. | |
| 2008/0280585 | A1 | 11/2008 | Chen et al. | |
| 2012/0188917 | A1* | 7/2012 | Knox | H01Q 9/0435 370/277 |
| 2013/0136209 | A1* | 5/2013 | Saunders | H04L 27/365 375/316 |

FOREIGN PATENT DOCUMENTS

| | | | |
|---|---|---|---|
| AU | 2002331739 | A1 | 3/2003 |
| WO | 03021804 | A1 | 3/2003 |

* cited by examiner

*Primary Examiner* — Robert Karacsony
(74) *Attorney, Agent, or Firm* — Suiter Swantz pc llo

(57) ABSTRACT

A quadrature fed four-port radiating element is fed by an active quadrature combiner feed network. The active quadrature four-port combiner is ultra-wide band and includes RF signal amplification. The resulting feeder exhibits a size reduction over existing passive balanced/unbalanced technology on the order of five thousand to one. Such antennas may be incorporated into radio frequency integrated circuit transmit/receive modules. Such antennas may also be integrated with front end low noise amplifiers. Such feeder network enables practical implementation of two-port feeders compatible with AESA array lattice restrictions.

15 Claims, 18 Drawing Sheets

Table I

Useful Values of $X_{a1}$

| | $TM_{21}$ | $TM_{31}$ | $TM_{41}$ | $TM_{51}$ | $TM_{61}$ |
|---|---|---|---|---|---|
| $X_{a1}$ | 3.054 | 4.201 | 5.317 | 6.415 | 7.501 |

| | MODE | RELATIVE DIELECTRIC CONSTANT | PEAK DIRECTIVITY | PEAK DIRECTION FROM ZENITH | RADIATOR DIAMETER |
|---|---|---|---|---|---|
| ——— | $TM_{21}$ | 1.25 | 6.9 dBI | 35° | $0.9\lambda_0$ |
| - - - - - - | $TM_{31}$ | 2.2 | 4.6 | 54° | 0.93 |
| ..... | $TM_{41}$ | 4.2 | 4.0 | 69° | 0.88 |

DIFFERENTIAL QUADRATURE RADIATING ELEMENTS AND FEEDS

BACKGROUND

Existing quadrifilar helix antennas have desirable circular polarization, beam width, and low to the horizon radiation patterns. Phase Quadrature driven arrays are the highest performing circularly polarized radiating elements, and quadrature phase antenna elements are known to have superior performance in terms of circular polarization; however, the passive combiner feeder mechanisms for such antennas are very large. Existing quadrature feed surfaces may be on the order of twelve thousand square millimeters; orders of magnitude larger than the radiating element. The large size of the feeder mechanism makes miniaturization for radio frequency (RF) integration difficult if not impossible. Also, existing quadrature feed mechanisms are passive in nature, which limits the functionality of the system.

Miniature, frequency tunable, and Ultra-wide Band (UWB) omnidirectional antenna technologies will be necessary features in contemporary and future communication systems. Those systems have stringent radiation parameter requirements, for example: broad beam radiating elements that feature high gain close to the horizon in vertical polarization and high polarization purity for circularly polarized (for example, in wide scan GPS/GNSS antennas, anti-jam controlled-reception pattern arrays, and fixed reception pattern arrays.

Advanced printed aperture printed circuit board based active electronically scanned arrays that operate outside of approximately the C—Ka Bands are difficult to manufacture due to printed circuit board material, and fabrication and assembly constraints.

SUMMARY

In one aspect, embodiments of the inventive concepts disclosed herein are directed to a quadrature fed four-port radiating element with an active quadrature combiner feed network. The active quadrature four-port combiner is ultra-wide band and includes RF signal amplitude and phase control. The resulting feeder exhibits a size reduction over existing passive balanced/unbalanced technology on the order of five thousand to one.

In a further aspect, such antennas may be incorporated into radio frequency integrated circuit transmit/receive modules. Such antennas may also be integrated with front end low-noise amplifiers, differential low-noise amplifiers and power amplifiers.

In a further aspect, such feeder network enables practical implementation of two-port feeders compatible with AESA array lattice restrictions.

It is to be understood that both the foregoing general description and the following detailed description are exemplary and explanatory only and should not restrict the scope of the claims. The accompanying drawings, which are incorporated in and constitute a part of the specification, illustrate exemplary embodiments of the inventive concepts disclosed herein and together with the general description, serve to explain the principles.

BRIEF DESCRIPTION OF THE DRAWINGS

The numerous advantages of the embodiments of the inventive concepts disclosed herein may be better understood by those skilled in the art by reference to the accompanying figures in which.

DETAILED DESCRIPTION

Figure 1:
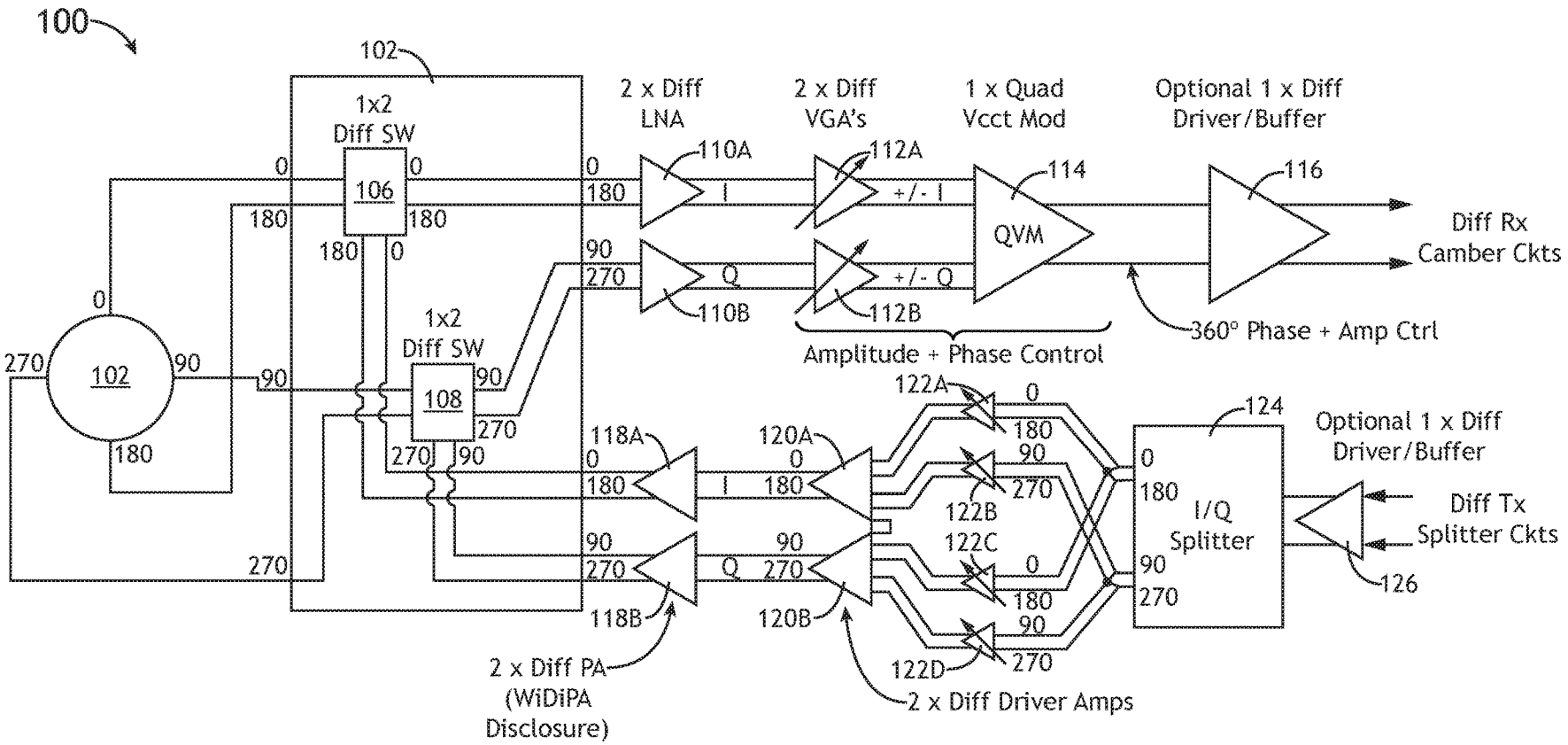
FIG. 1 shows a circuit diagram of a full duplex transmit/receive mode of a dual-polarized radiating element with quadrature feed network.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to a quadrature fed four-port radiating element with an active quadrature combiner feed network. The active quadrature four-port combiner is ultra-wide band and includes RF signal amplification. The resulting feeder exhibits a size reduction over existing passive balanced/unbalanced technology on the order of five thousand to one.

Referring to FIG. 1, a circuit diagram 100 of a full duplex transmit/receive mode of a dual-polarized radiating element 102 with differential switches 106, 108 is shown. The operation of the circuit 100 may be more fully understood with reference to U.S. Pat. No. 9,537,558 which is incorporated by reference, specifically with respect to amplitude and phase manipulation. The dual-polarized radiating element 102 is connected to a quadrature transmit/receive switch 104 to switch between a receive channel and a transmit channel. When in a receive mode, a first differential switch 106 in the quadrature transmit/receive switch 104 electronically configures the dual-polarized radiating element 102 to receive signals in a first phase and a second phase one-hundred eighty degrees from the first phase; the first phase and second phase comprising an in-phase ("I") component. Furthermore, a second differential switch 108 in the quadrature transmit/receive switch 104 electronically configures the dual-polarized radiating element 102 to receive signals in a third phase, ninety degrees from the first phase, and a fourth phase one-hundred eighty degrees from the third phase; the third phase and fourth phase comprising a quadrature ("Q") component. The dual-polarized radiating element 102 is thereby configured to receive ninety-degree phase shifted quadrature signals.

The received signals are amplified by one or more differential low-noise amplifiers 110A, 110B and by one or more variable gain amplifiers 112A, 112B. In at least one embodiment, a first low-noise amplifier 110A and a first variable gain amplifier 112A receive signals corresponding to the I component signals in the first phase and the second phase, while at the same time a second low-noise amplifier 110B and a second variable gain amplifier 112B receive Q component signals corresponding to the signals in the third phase and the fourth phase.

A quadrature vector modulator 114 receives the vector I component signals and Q component signals and outputs a composite differential phase shifted signal that is a controllable composite of the differential I and Q vector inputs. A full 360-degree precision phase control and precision gain control is enabled by the variable gain amplifiers 112A, 112B and quadrature vector modulator 114 as may be more fully understood with reference to U.S. Pat. No. 9,537,558. In at least one embodiment, the variable gain amplifiers 112A, 112B and quadrature vector modulator 114 comprise an amplitude and phase controller. In at least one embodiment, the two phase shifted signals maybe received by a differential driver/buffer 116 before being delivered to any signal processing circuitry. The variable gain amplifiers 112A, 112B may also apply a 180-degree phase shift, which enables the phase relationship of +I to −I and +Q to −Q or any combination of I/Q such as (+I, −Q), (−I,+Q), (+I,+Q), (−I,−Q).

When in a transmit mode, a quadrature splitter 124 receives one or more signals from processing circuitry, and potentially from a differential driver/buffer 126. The quadrature splitter 124 produces signals in a first phase and a second phase one-hundred eighty degrees from the first phase, and signals in a third phase, ninety degrees from the first phase, and a fourth phase one-hundred eighty degrees from the third phase. Variable gain amplifiers 122A, 122B, 122C, 122D receive the phase split signals and deliver amplified signals to one or more quadrature vector modulator 120A, 120B. Variable gain amplifiers 122A, 122B and a quadrature vector modulator 120A perform the same function as the variable gain amplifiers 112A, 112B and quadrature vector modulator 114 in the receive channel for an I vector component. Likewise, variable gain amplifiers 122C, 122D and a quadrature amplifier 120B perform the same function for a Q vector component. Each I and Q has full 360-degree and amplitude control for stimulating the radiating element 102.

In at least one embodiment, a first variable gain amplifier 122A receives the first signal and second signal, and a second variable gain amplifier 122B receives the third signal and the fourth signal. A first differential driver amplifier 120A receives signals from the first variable gain amplifier 122A and the second variable gain amplifier 122B, and output signals corresponding to an I component (a first signal with no phase adjustment and a second, orthogonal signal with one-hundred-eighty-degree phase adjustment).

In at least one embodiment, a third variable gain amplifier 122C receives the first signal and second signal, and a fourth variable gain amplifier 122D receives the third signal and the fourth signal. A second differential driver amplifier 120B receives signals from the third variable gain amplifier 122C and the fourth variable gain amplifier 122D, and outputs signals corresponding to a Q component (a third signal phase adjusted by ninety degrees and a fourth, orthogonal signal with two-hundred-seventy-degree phase adjustment).

A first differential power amplifier 118A receives the I component signals while a second differential power amplifier 118B receives the Q component signals. The first differential switch 106 in the quadrature transmit/receive switch 104 electronically configures the dual-polarized radiating element 102 to transmit I component signals from the first differential power amplifier 118A while the second differential switch 108 in the quadrature transmit/receive switch 104 electronically configures the dual-polarized radiating element 102 to transmit Q component signals from the second differential power amplifier 118B.

The system may be configured for receive only or transmit only. Transmit and receive channels may comprise separate apertures similar to airborne Ku Band SatCom. In at least one embodiment, ½ duplexing is realized with the quadrature transmit/receive switch 104. Furthermore, each differential "paired" signal may be modified independently of the other "paired" signal to create variations where each independent signal is no longer ninety degrees apart from the others.

Figure 2A:
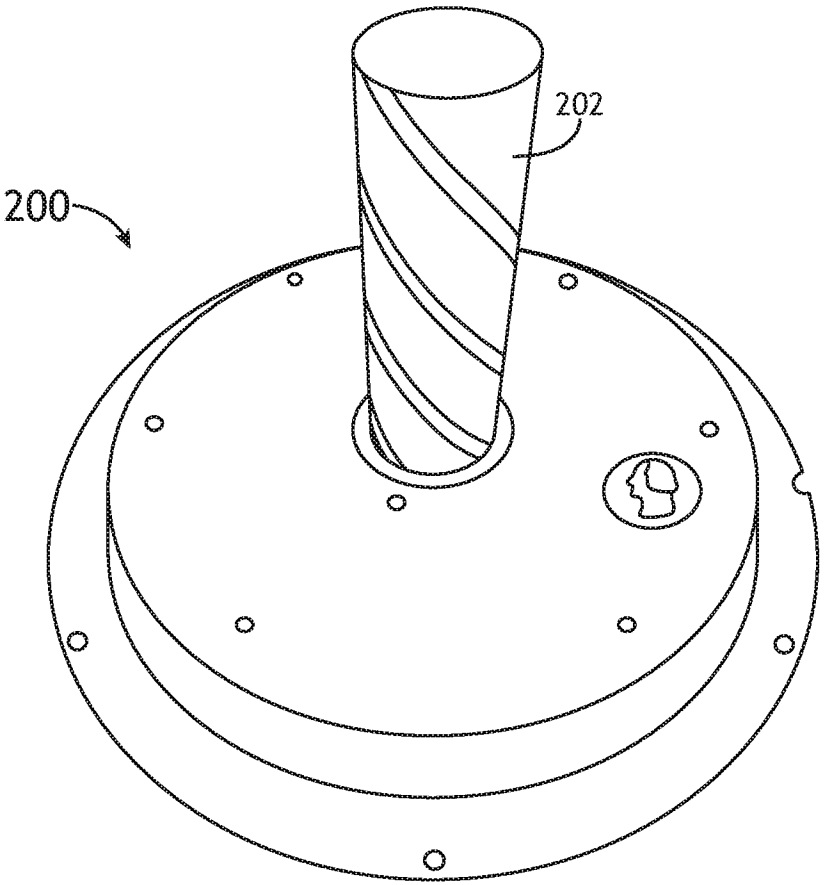
FIG. 2A shows a perspective view of a helical antenna.
Figure 2B:
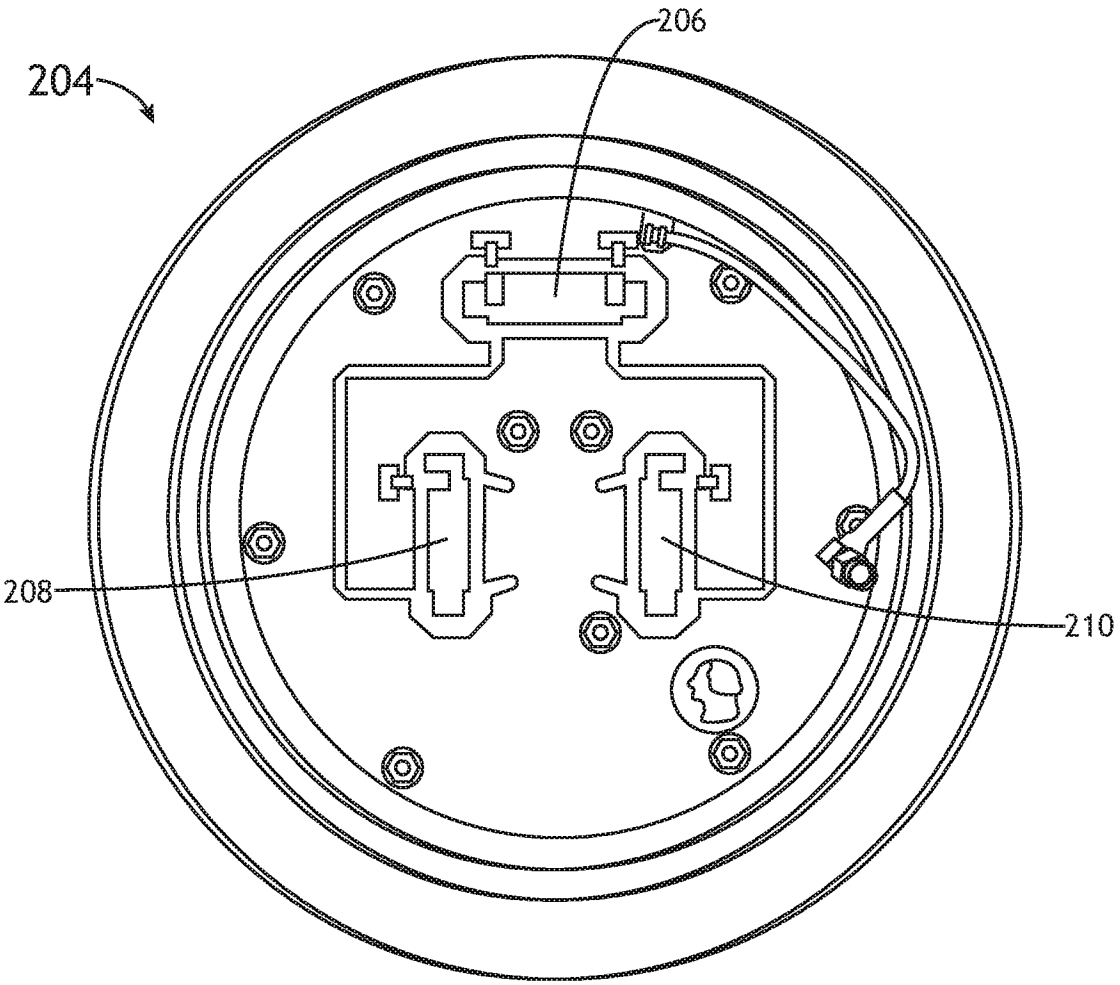
FIG. 2B shows a top view of a passive feeder for a helical antenna.
Figure 2C:
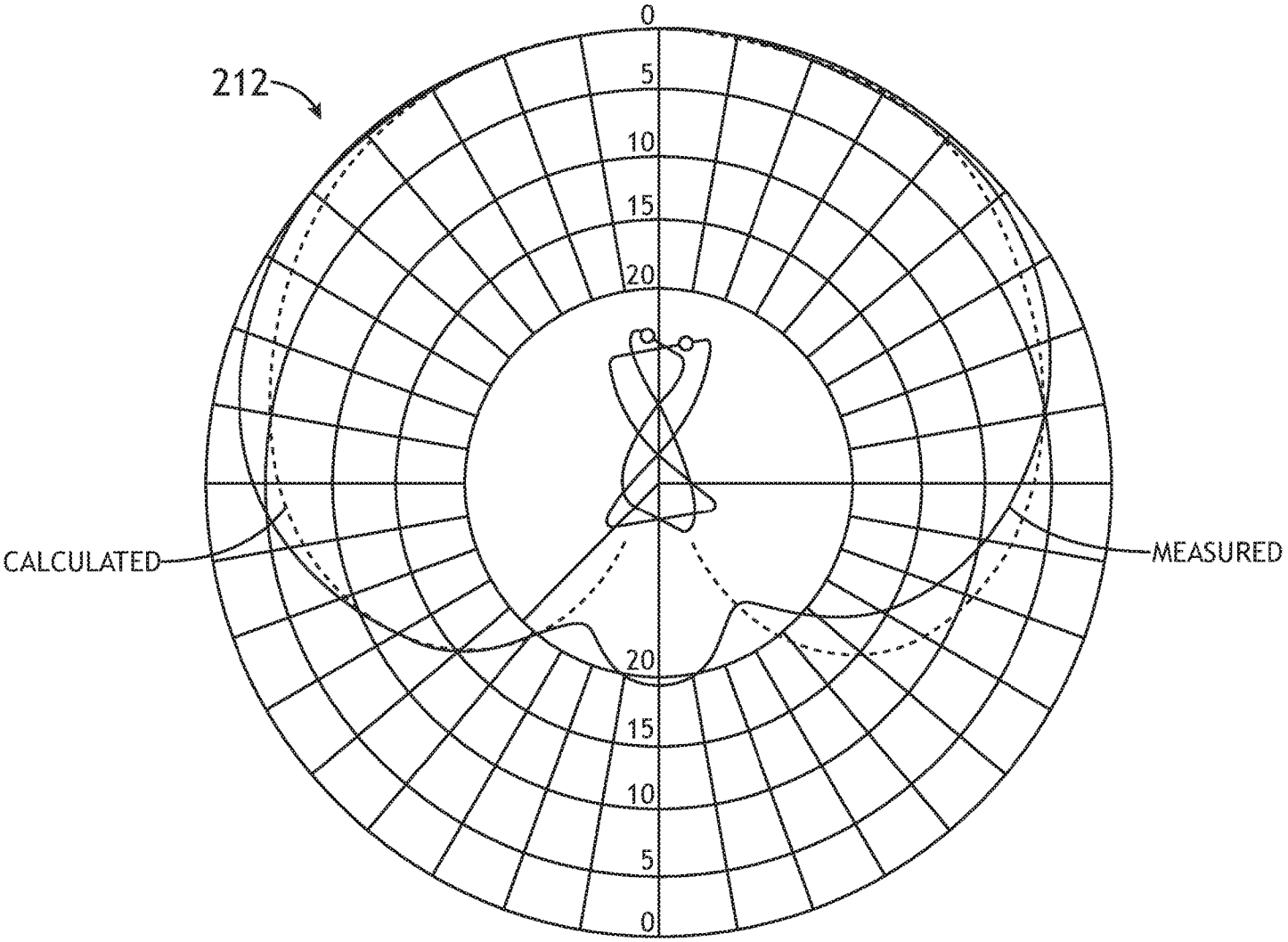
FIG. 2C shows a radiation pattern diagram for a helical antenna.
Figure 3A:
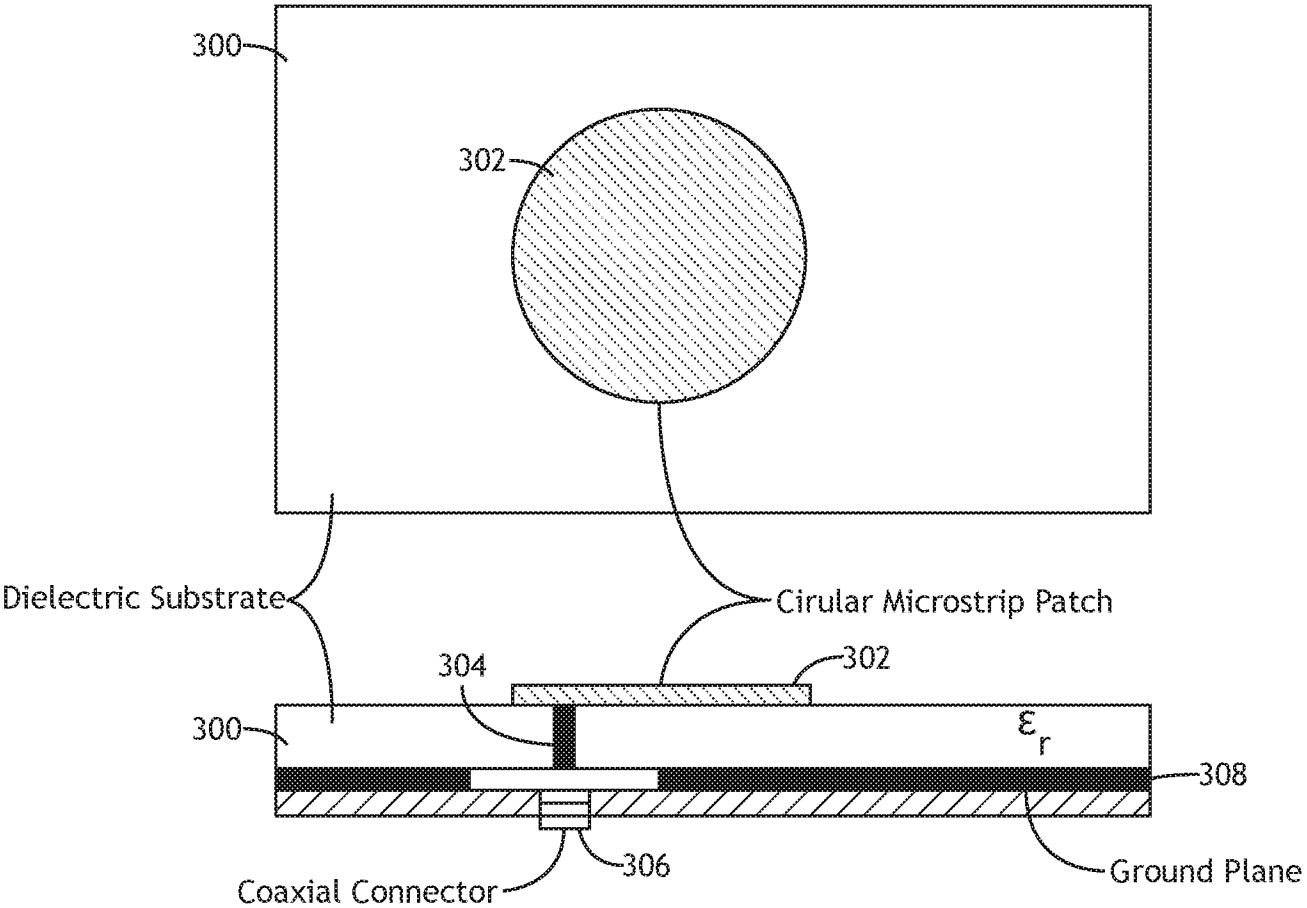
FIG. 3A shows a top view and side view of a circular microstrip patch.
Figure 3B:
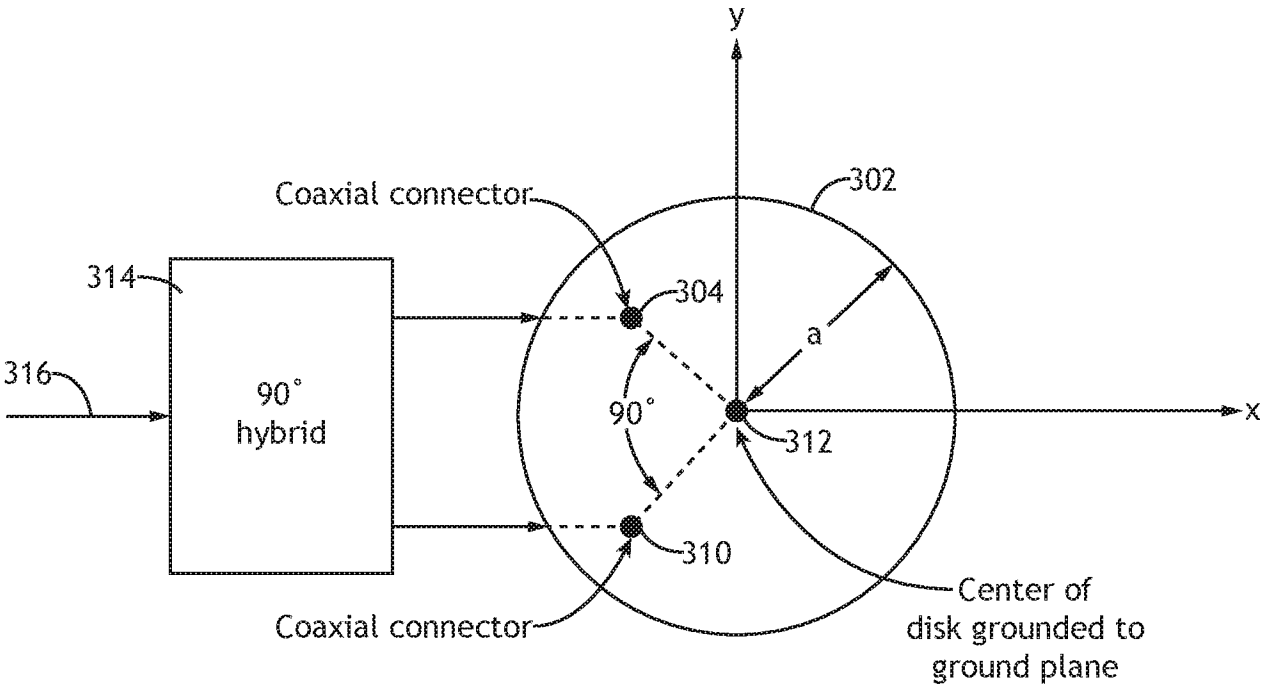
FIG. 3B shows a diagram of a two-probe fed circular microstrip patch.
Figure 3C:
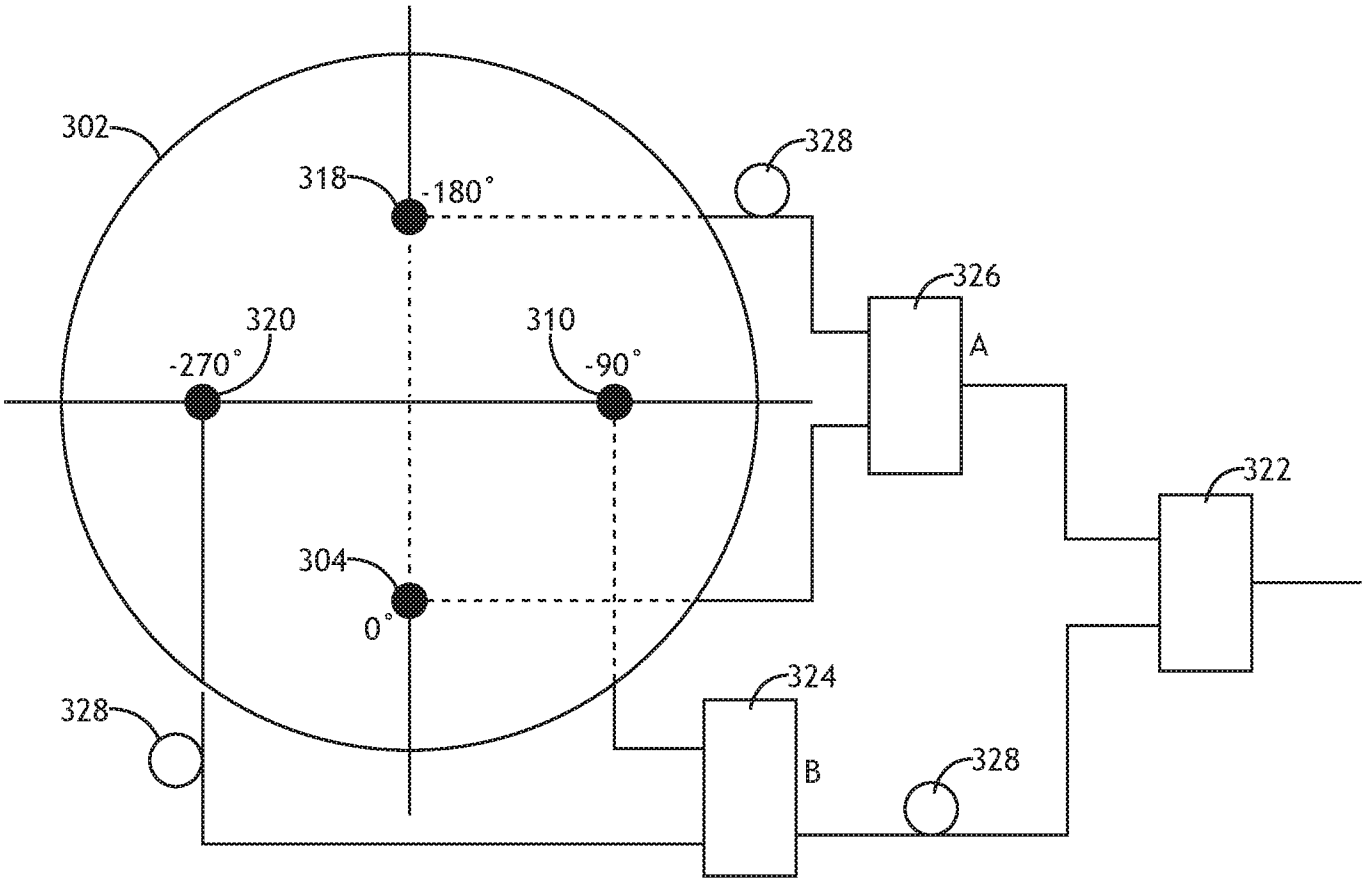
FIG. 3C shows a diagram of a four-probe feeding method.
Figure 3D:
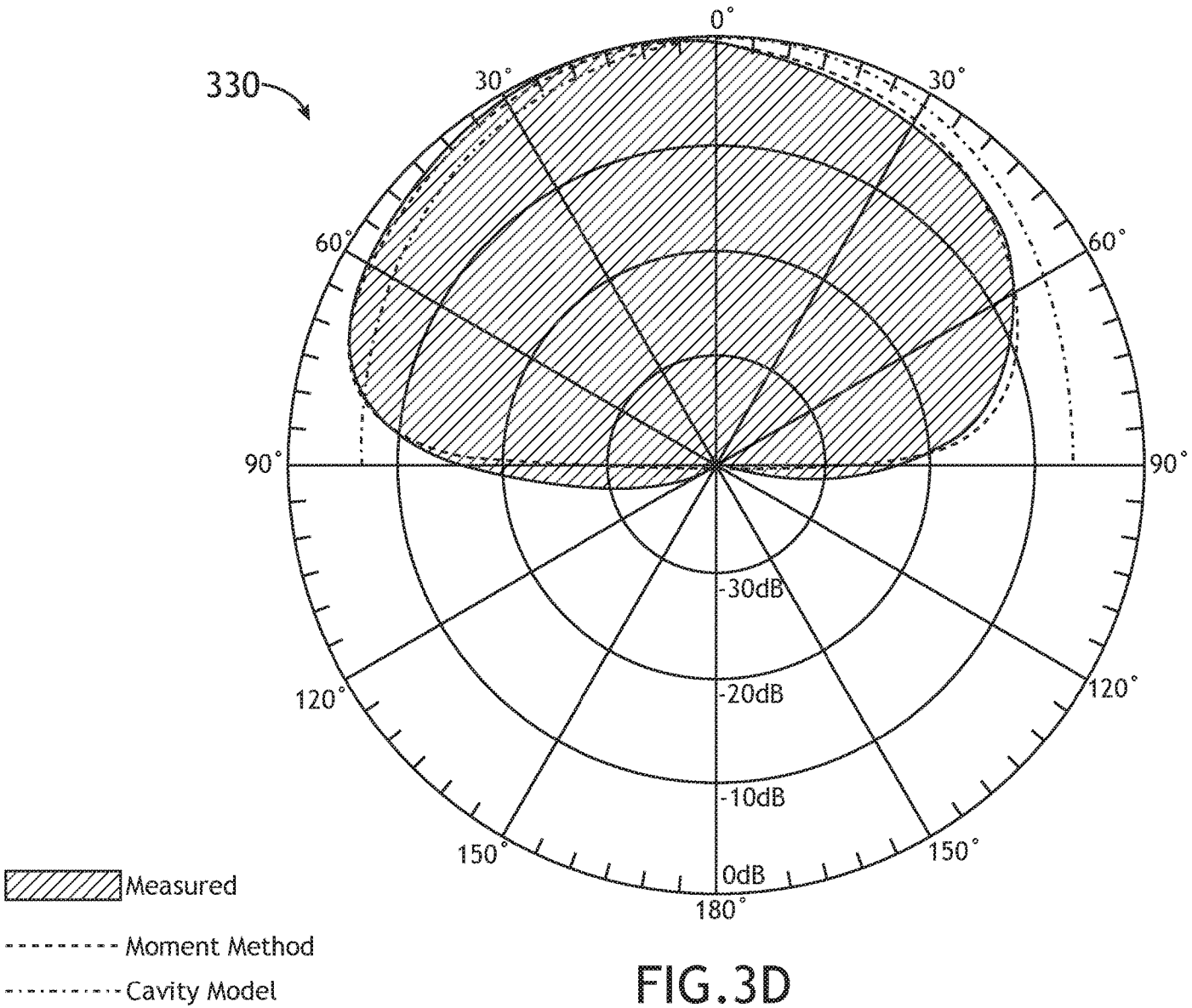
FIG. 3D shows a radiation pattern diagram for a microstrip patch.

Referring to FIGS. 2A-2C, (2C from C. C. Kilgus, Multielement Fractional Turn Helices, 1968), a quadrifilar helical antenna 200, passive feeder 204, and corresponding radiation pattern 212 diagram are shown. The quadrifilar helical antennas 200 comprises a helical radiating element 202. Quadrifilar helical antennas 200 have superior circular polarization, broad beam width, and low to the horizon radiation patterns 212. Quadrifilar helical antennas 200, even miniaturized ceramic loaded ones, are typically bottom fed via a quadrature combiner 204 in order to facilitate a simpler, planar feed network with minimal parasitic reactance.

Passive quadrature combiners 204 may include a first splitter/combiner 206 that receives a signal from, or delivers a signal to, an RF source. The first splitter/combiner 206 feeds secondary splitters/combiners 208, 210 that directly feed helical radiating elements 202 to produce a radiating pattern 212. Such passive quadrature combiners 204 create noise and diminish effective isotropic radiated power between radiating elements and the low-noise amplifiers. Passive Quadrature Combiners 204 have a wavelength dependent circuit surface area on the order of 110 mm by 110 mm (12,321 $mm^2$), 8% instantaneous bandwidth, approximately −2.0 dB fixed insertion Loss, and a fixed quadrature phase.

As compared to passive quadrature combiners, active quadrature feed combiners allow for electronic adjustment of the amplitude/phase/delay from nominal quadrature settings to enable polarization diversity, and pattern shaping/nulling in addition to size reduction.

Referring to FIGS. 3A-3D, originally Constantine A. Balanis, *Antenna Theory: Analysis and Design,* $3^{rd}$ *Ed.* (2005) and T. Chiba, Y. Suzuki, N. Miyano, *Suppression of higher modes and cross polarized component for microstrip antennas* (1982), a circular microstrip patch 302, feeding method diagram, and corresponding radiation pattern 330 diagram are shown; microstrip patches are high Q, narrow band, and typically require specific tuning during production. A circular microstrip patch 302 disposed on a dielectric substrate 300 is fed by two or more vias 3304, 310, 318, 320 (and potentially four vias 304, 310, 318, 320) connected to an RF source by corresponding coaxial connectors 306 (or similar signal transmission features). The one or more vias 3304, 310, 318, 320 may pass through an opening of ground plane layer 308. In at least one embodiment, the circular microstrip patch 302 is connected to the ground plane layer 308 by a separate ground plane via 312.

In at least one embodiment, for the narrow band application where the circular microstrip patch 302 is fed by two signals to two coaxial connectors and vias 3304, 310 (as in FIG. 3B), a splitter 314 may split the input signal 316. The split signal (which may also be phase transformed) is sent to the two coaxial connectors and vias 3304, 310, which are disposed 90° apart. Two orthogonal feeds enable circular polarization but produces a high Q with very narrow circular polarization band width.

In at least one embodiment, for example where the circular microstrip patch 302 is fed by four signals to four coaxial connectors and vias 3304, 310, 318, 320 (as in FIG. 3C), splitters 322, 324, 326 may split the input signal and delays 328 may alter the phase of the corresponding signals. The split and phase adjusted signals are sent to the four coaxial connectors and vias 3304, 310, 318, 320 to produce a radiating pattern 330 as measured experimentally and calculated by various models. Four quadrature feed excited patches are known to have superior circular polarization performance relative to dual orthogonal feed embodiments, but passive quadrature feeds are physically larger than the radiating element itself.

Referring to FIGS. 4A-4D, originally from John Huang, Circularly Polarized Conical Patterns from Circular Microstrip Antennas (1984), a diagram of magnetic fields under a circular microstrip patch, angular spacing of two-probe feeds, angular spacing of four-probe feeds, and the corresponding radiation pattern diagram are shown. Under certain defined signal conditions, vias 406 408, 410 may excite the corresponding radiating element 400, 402, 404 to produce magnetic fields 420 that define sectors of the radiating element 400, 402, 404. It may be appreciated that while only one via 406 408, 410 is shown, more than one via 406 408, 410 may be used; for example, two or four vias 406 408, 410 are contemplated. Specifically (as in FIG. 4A), a circular microstrip patch 412 may include two vias 414, 416 disposed 90° apart. In at least one embodiment, where the circular microstrip patch 400, 402, 404, 418 is fed by four vias, magnetic fields may be generated that define 30°, 45°, 67.5°, 90°, or higher resonate modes to achieve monopole-like end fire radiation. Such embodiments may generate various radiating patterns 420 according to the number of resonant modes.

Figure 4A:
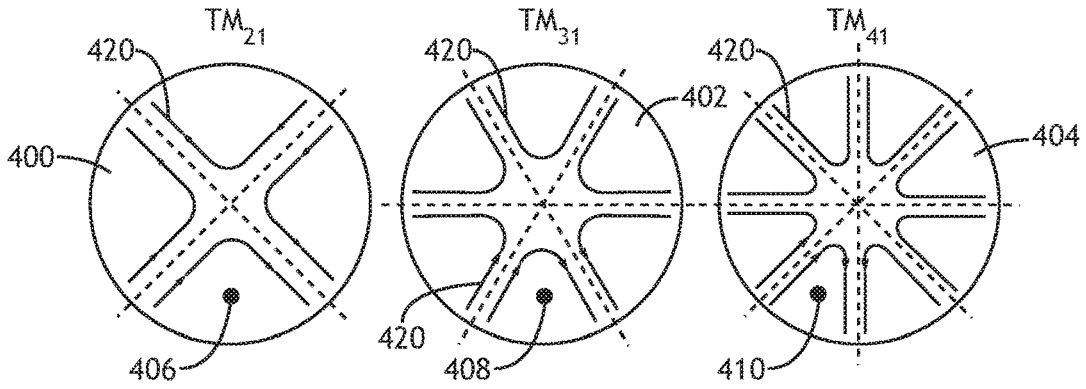
FIG. 4A shows a diagram of magnetic fields under a circular patch.
Figure 4B:
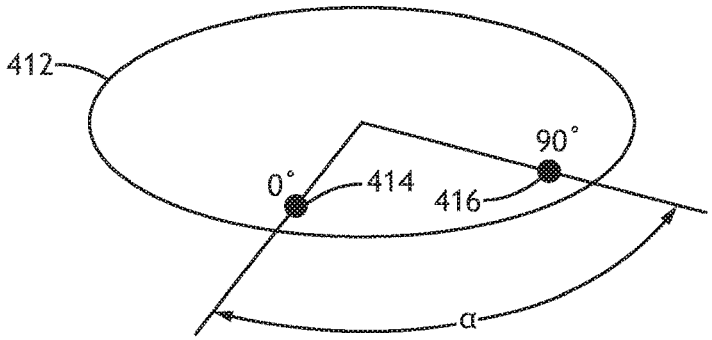
FIG. 4B shows a perspective diagram of angular spacing of two-probe feeds.
Figure 4C:
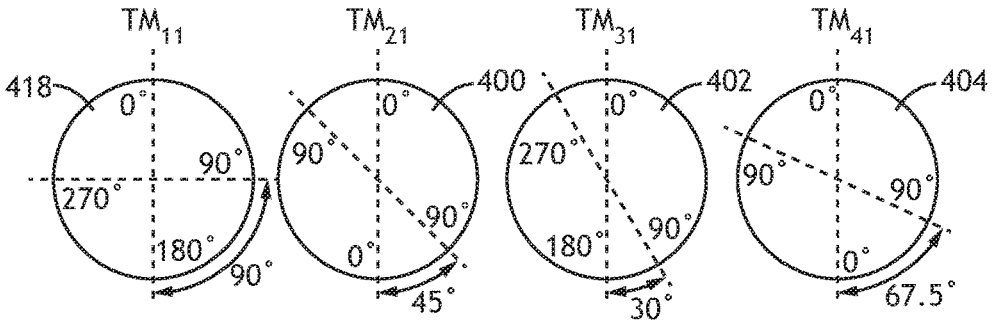
FIG. 4C shows a diagram of angular spacing of four-probe feeds.
Figure 4D:
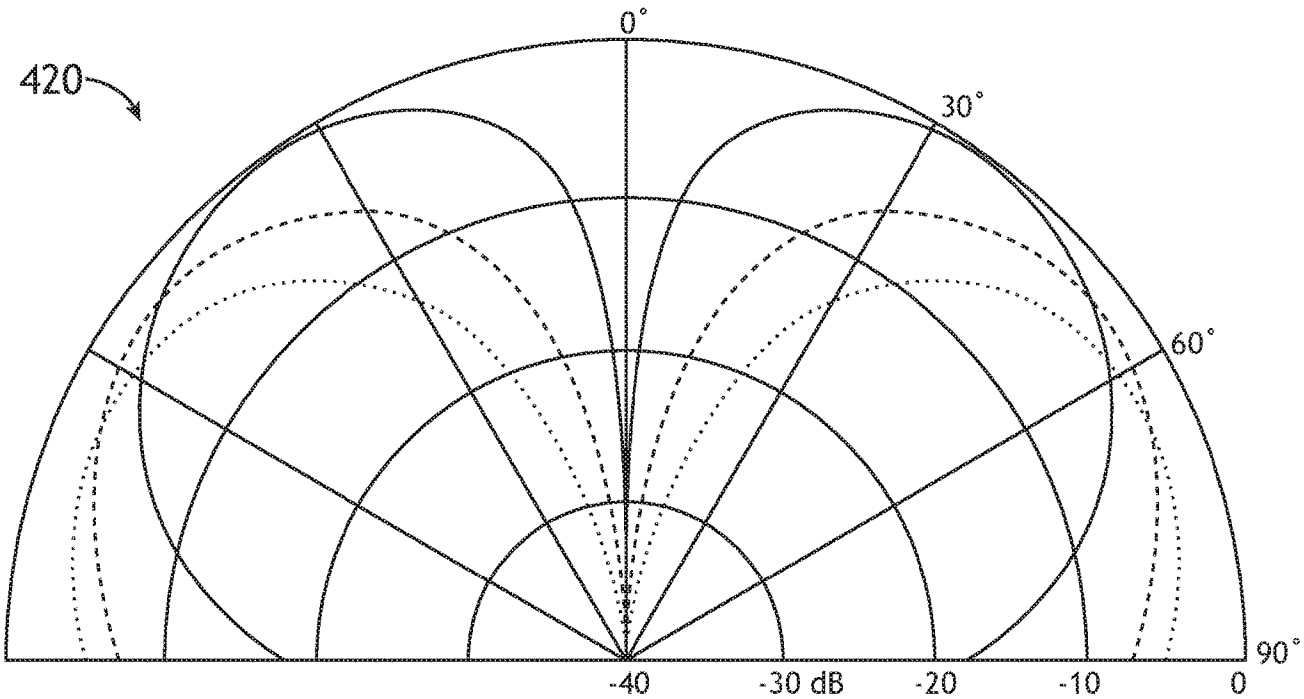
FIG. 4D shows a radiation pattern diagram of higher order modes for a circularly polarized circular microstrip patch.

Referring to the table if FIG. 4D, the TM41 mode has a low angle vertically polarized radiation pattern that is suitable for many system applications. The balanced nature of four-feed quadrature tends to suppress higher ordered asymmetric modes. As compared to active quadrature, passive quadrature feeds are typically narrow band and therefore need to be uniquely designed for the intended mode of operation. For omnidirectional applications it is possible for an active quadrature combiner, with amplifier gain, to superimpose two patch antennas, each of the TM11 and TM41, modes, if non-phase center coincidence is tolerable in terms of greater systems requirements.

Figure 5A:
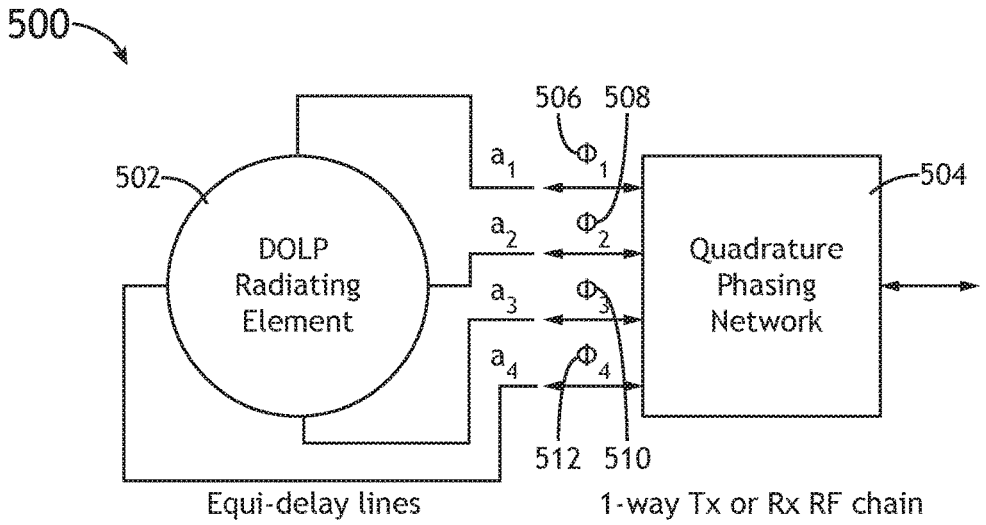
FIG. 5A shows a block diagram of a dual-polarized radiating element and quadrature feed network.
Figure 5B:
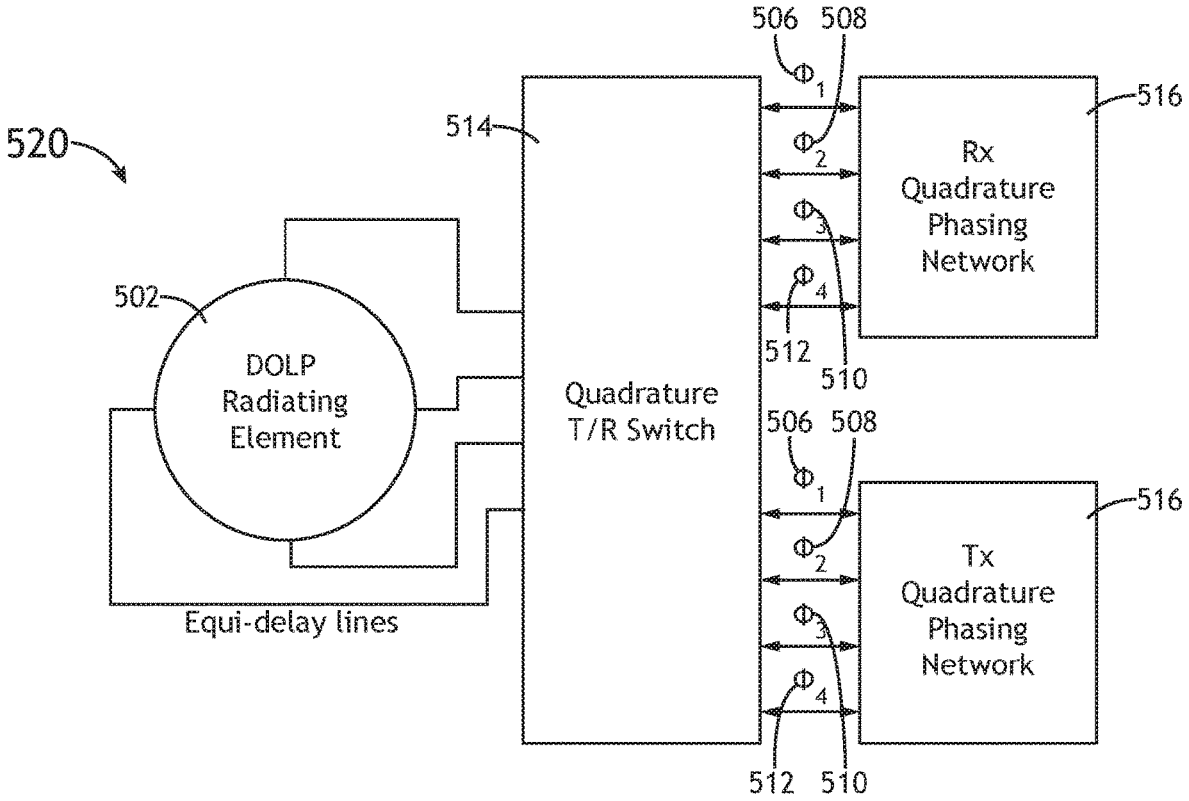
FIG. 5B shows a block diagram of a dual-polarized radiating element and quadrature feed network.
Figure 6A:
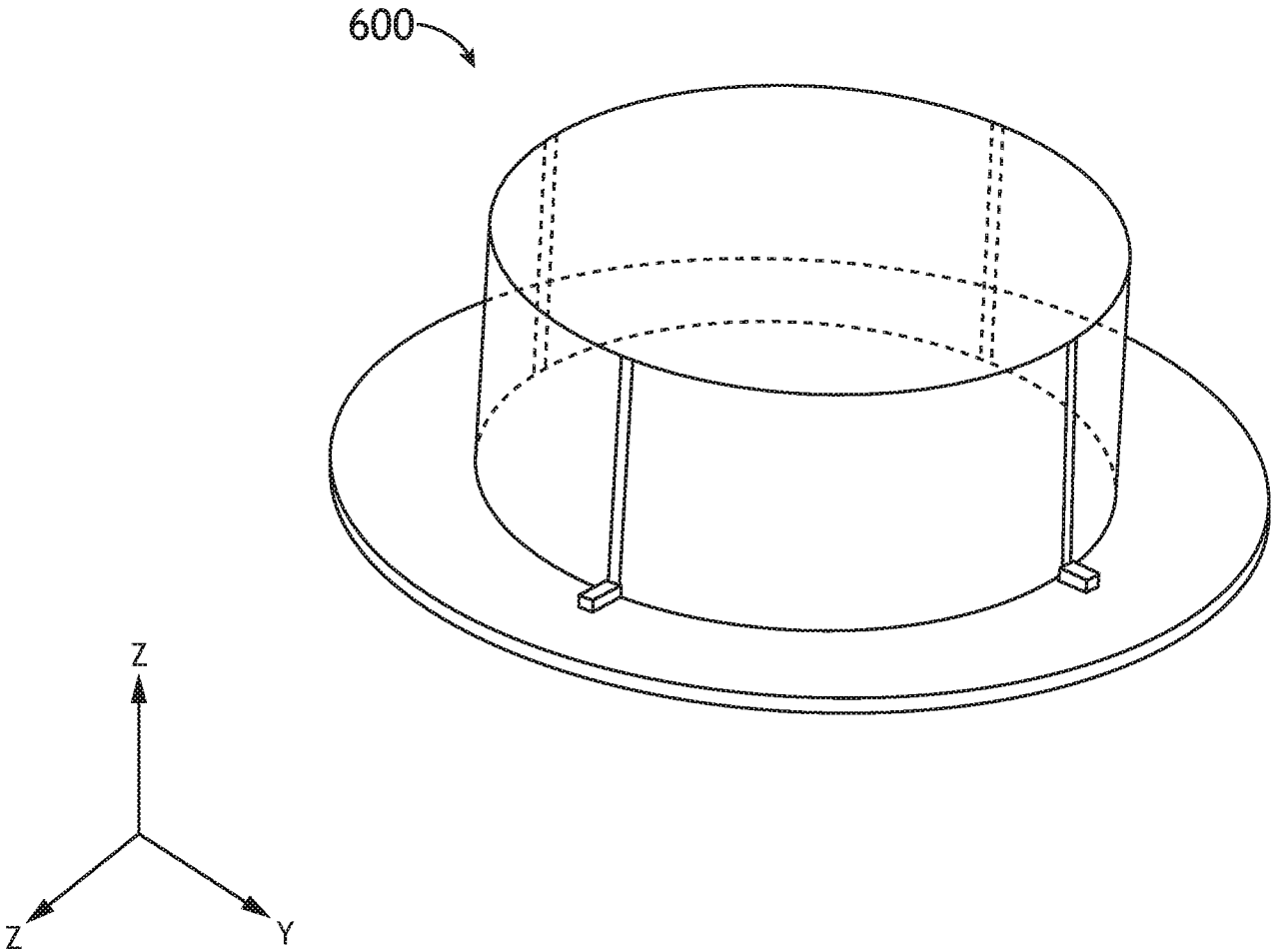
FIG. 6A shows a perspective view of a dielectric resonator antenna.
Figure 6B:
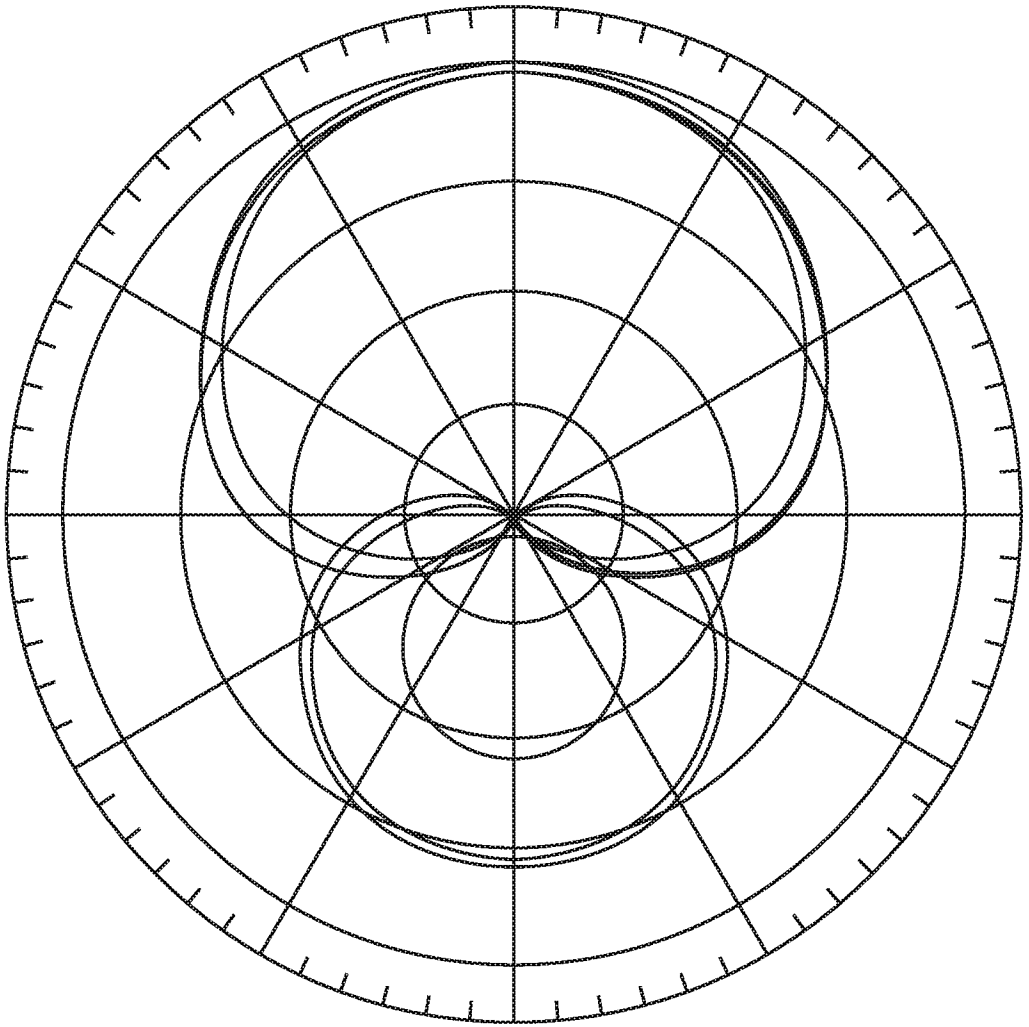
FIG. 6B shows a diagram of the elevation radiation pattern for a dielectric resonator antenna.
Figure 6C:
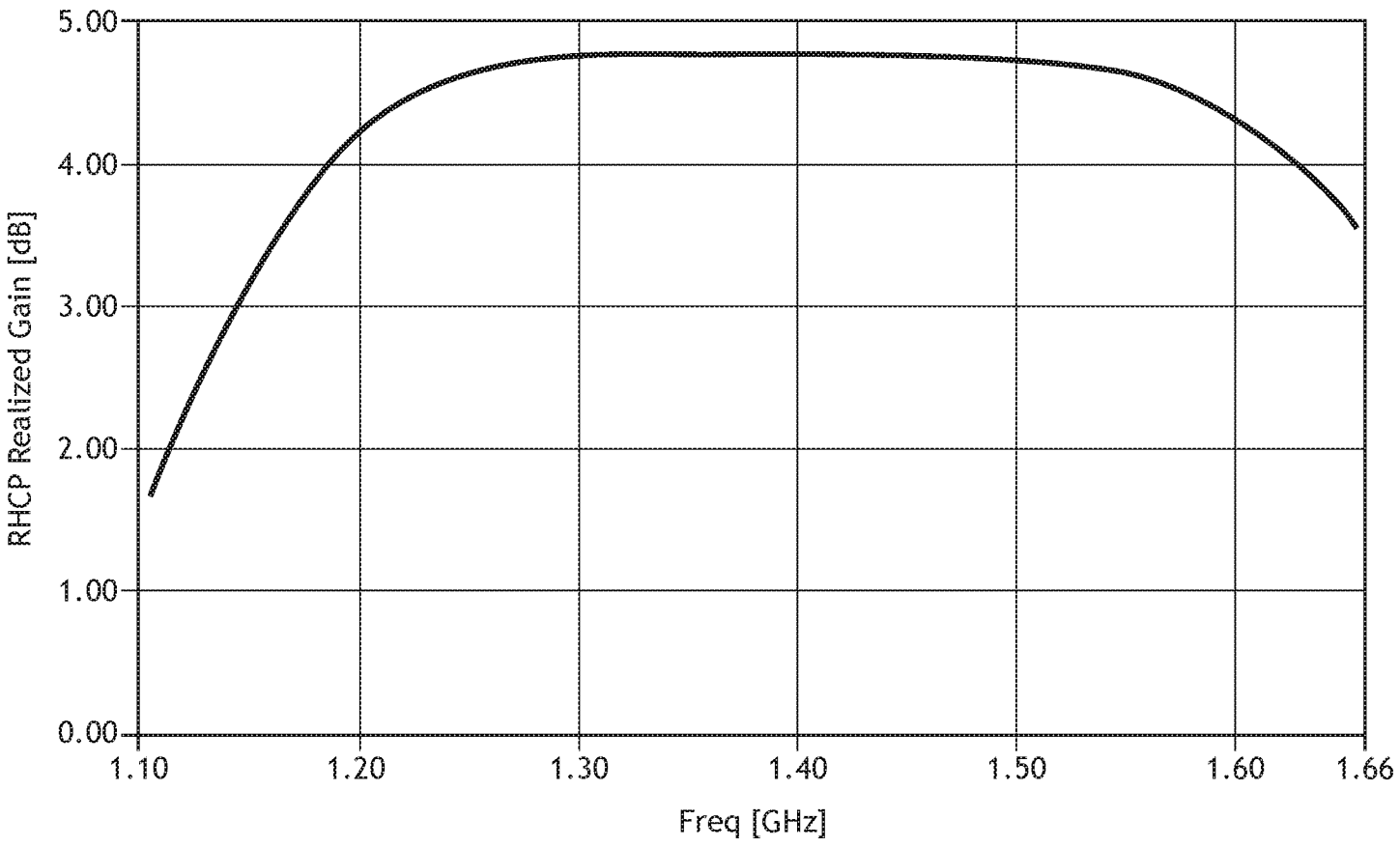
FIG. 6C shows a graph of gain with respect to frequency for a dielectric resonator antenna.
Figure 6D:
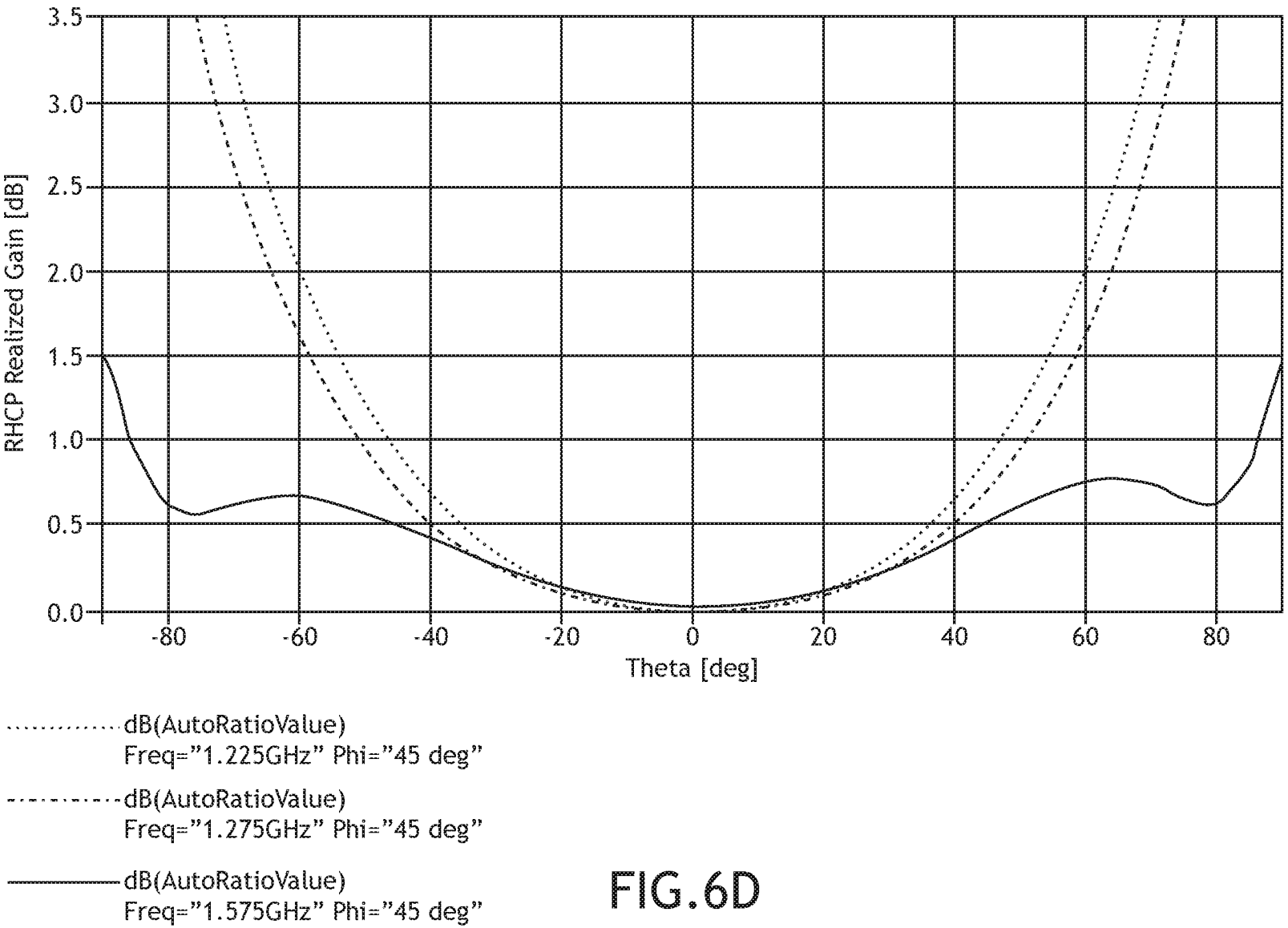
FIG. 6D shows a graph of axial ratio with respect to elevation angle for a dielectric resonator antenna.

Referring to FIGS. 5A-5B, block diagrams of a quadrature fed radiating element 502 and quadrature feed network 504, 516, 518 are shown. Quadrature fed radiating elements 502 are fed by four signals 506, 508, 510, 512, each offset in phase according to the desired radiating pattern. The four signals 506, 508, 510, 512 are produced by quadrature phasing networks 504, 516, 516, 518. In at least one embodiment, the quadrature fed radiating elements 502 may comprise dual orthogonal polarized radiating elements.

In at least one embodiment 500, where the feed circuitry is configured for transmit or reception, the quadrature phasing network 504 is configured to produce signals 506, 508, 510, 512 with 90° phase disparity.

In at least one embodiment 520, where the feed circuitry is configured for transmit and reception, a reception quadrature phasing network 516 is configured to receive signals 506, 508, 510, 512 with 90° phase disparity. Furthermore, a transmission quadrature network 518 is configured to produce signals 506, 508, 510, 512 with 90° phase disparity. First order, active quadrature feed RF integrated circuit size is independent of frequency over its operating band. Variable gain/phase enables precise calibration with less than 0.05 dB and 0.25° phase tuning resolution low-noise amplifiers with stages that can be integrated into the active quadrature feed for optimal reception noise. An amplifier can be integrated into the active quadrature feed to drive the radiating element for optimal transmission effective isotropic radiated power. Fixed tuned or tunable low pass, high pass, band stop, or band pass filters can be integrated in the integrated for electromagnetic interference protection and jammer signal immunity.

Variable gain/phase enables precise calibration, statically and dynamically optimal axial ratio, dynamic axial ratio adjustments applicable to wide scan circular polarization active electronically scanned array architectures. Furthermore, polarization diversity, arbitrarily inclined linear polarization, and arbitrary elliptical polarity which enables increased system channel capacity, multipath rejection, nulling within the radiating element's radiation pattern, dynamic polarizations matching, etc. Such architecture is applicable to transmit only, reception only, or half duplex active electronically scanned array architectures.

Such circuits may be a core component of GPS/GNSS anti-Jam beam forming along with reconfigurability for COMM and GPS-denied DF systems modes.

Referring to FIGS. 6A-6D, referenced from M. Khalily, M. Rahim, A. Khalajmehrabadi, M. Kamarudin, *A Compact Circularly Polarized and Wideband Rectangular Dielectric Resonator Antenna* (2011), a perspective view of a dielectric resonator antenna 600, radiation pattern elevation and azimuth, and graphs of gain/axial ratios with respect to frequency and axial ratios with respect to elevation angle for a dielectric resonator antenna 600 are shown.

Dielectric resonator antennas 600 are useful for their higher performance relative to their small electrical size; their advantages include flexibility in size and cheap dielectric material options. EM fields are expressed as cavity modes, similar to that of microstrip antenna field analysis. Dielectric resonator antennas 600 can be driven in a two-feed or four-feed fashion, and therefore can be fed in phase quadrature, as described herein.

Figure 7:
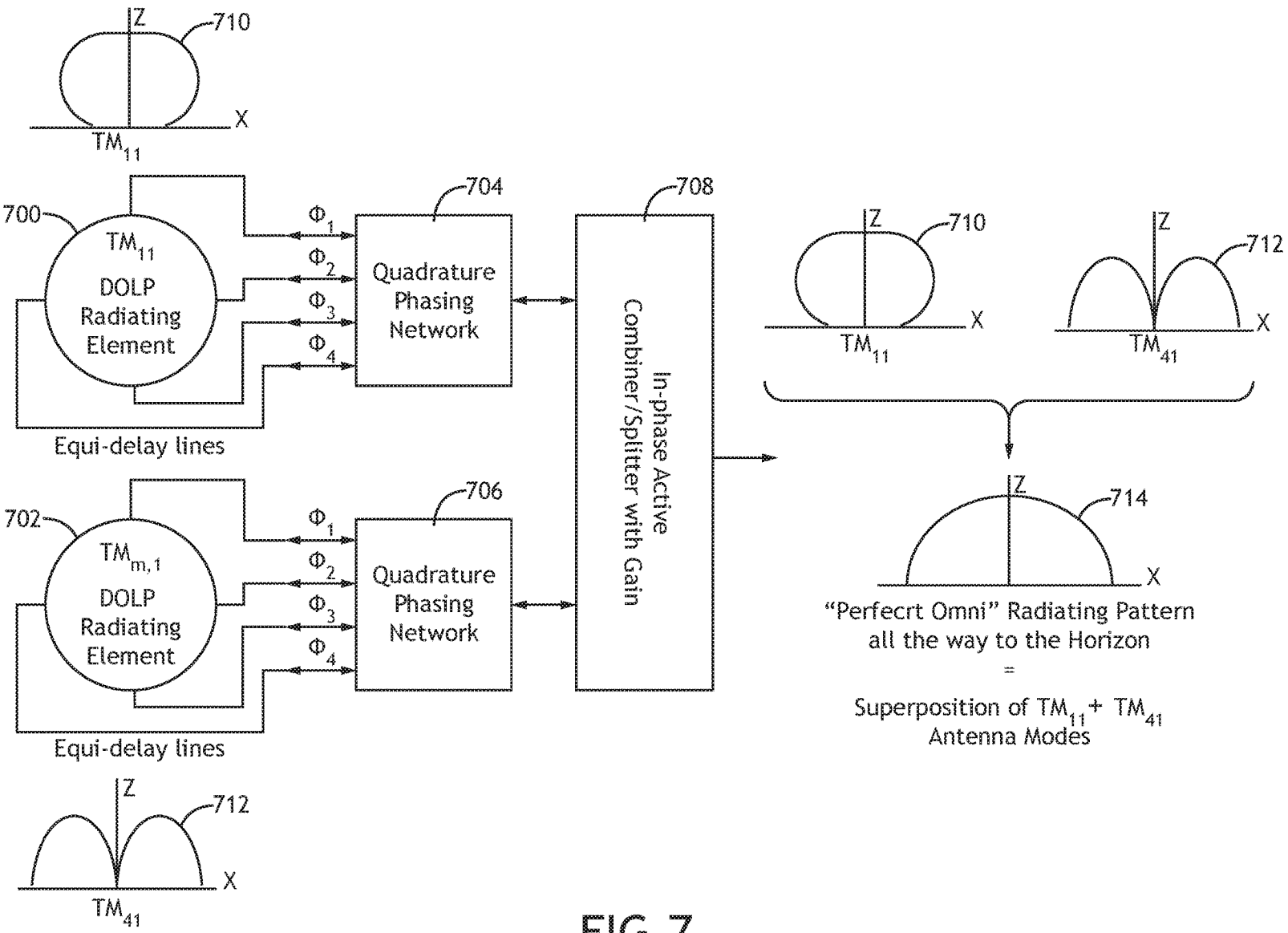
FIG. 7 shows a diagram of a combined system of dual-polarized radiating elements using quadrature feed networks to produce a hybrid radiating pattern.

Referring to FIG. 7, a diagram of a combined system of quadrature fed radiating elements 700, 702 using quadrature feed networks 704, 706 to produce a hybrid radiating pattern 714 is shown. In at least one embodiment, an antenna comprises at least two radiating elements 700, 702 (or at least two sets of radiating elements 700, 702). A first radiating element 700 is fed by a first quadrature feed network 704 configured to produce a first radiating pattern 710; likewise, a second radiating element 702 is fed by a second quadrature feed network 706 configured to produce a second radiating pattern 712. In a receive mode, an in-phase active combiner/splitter 708 connected to each of the first quadrature feed network 704 and second quadrature feed network 706 superimposes (or blends) the signals received from each quadrature feed network 704, 706. In a transmit mode, the in-phase active combiner/splitter 708 splits a signal from an RF source and send the corresponding signals to each of the quadrature feed networks 704, 706. An antenna utilizing such quadrature fed radiating elements 700, 702 may have the first set of radiating elements 700 interleaved with the second set of radiating elements 702. Alternatively, the first set of radiating elements 700 may be disposed in the center of an antenna while the second set of radiating elements 702 are disposed around the periphery of the antenna.

In at least one embodiment, the hybrid radiating pattern 714 is a superposition of a low elevation angle gain radiating pattern with high gain at the horizon but null at the zenith (the first radiating pattern 712) and a radiating pattern with low gain at the azimuth and high gain at the zenith (the second radiating pattern 710). More than two modes may be superimposed to produce other desired radiating patterns.

Figure 8A:
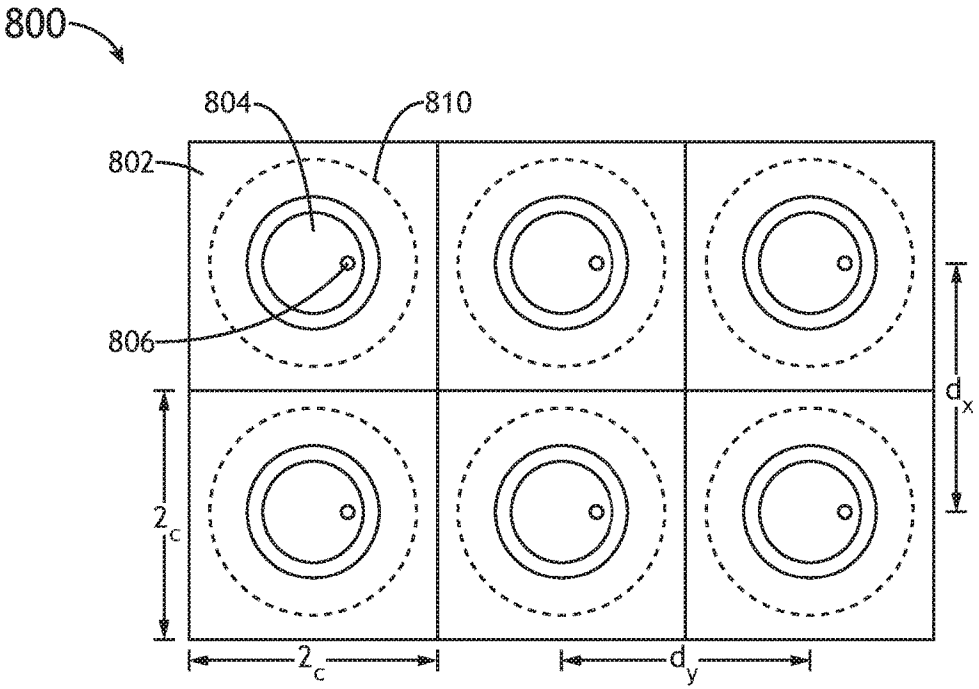
FIG. 8A shows a top view of a circular patch array.
Figure 8B:
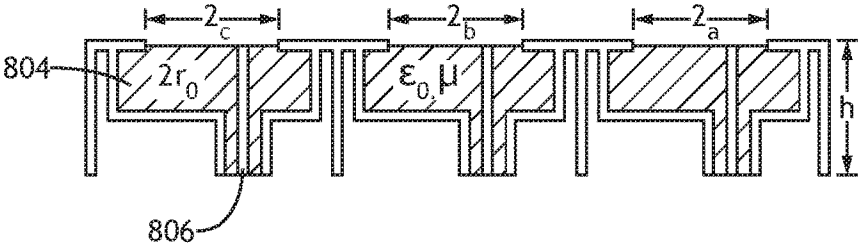
FIG. 8B shows a side view of a circular patch array.
Figure 8C:
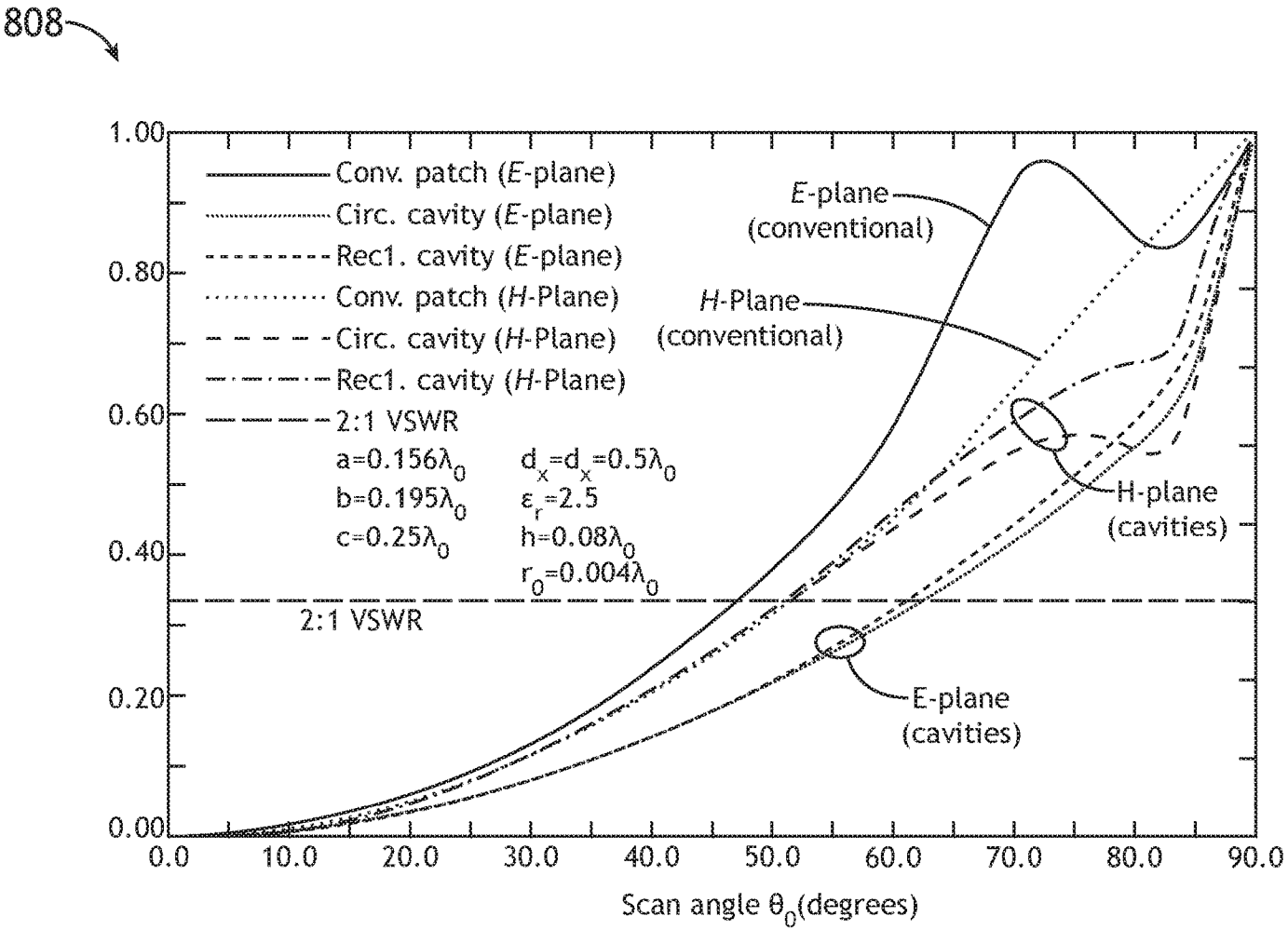
FIG. 8C shows a graph of reflection coefficients with respect to scan angles for circular microstrip patch arrays.

Referring to FIGS. 8A-8C, originally Constantine A. Balanis, *Antenna Theory: Analysis and Design,* 3$^{rd}$ *Ed.* (2005) and J. T. Aberle and F. Zavosh, *Analysis of Probe-Fed Circular Microstrip Patches Backed by Circular Cavities, Electromagnetics*, Vol. 14, pp. 239-58 (1994), top and side views of a circular microstrip patch array 800, and a graph 808 of reflection coefficients with respect to scan angles for circular microstrip patch arrays 800 are shown. The circular microstrip patch array 800 includes a plurality of radiating elements 802, each comprising a circular microstrip patch 804 fed by two or more vias 806 (and potentially four vias 806). Such array 800 may be fed by an active quadrature feed network as described herein. The balanced nature of the four-feed quadrature feed network tends to suppress higher order asymmetric modes, and will therefore exhibit superior circular polarization performance relative to dual orthogonal feed embodiments. Passive quadrature feeds are too physically large to accommodate the array lattice spacing constraints of $\lambda^2/4$ unit cell (i.e. $\lambda/2$ by $\lambda/2$ element size) surface area for grating lobe-free operation. An active quadrature feed network enables high performance four-port feed radiating elements within the array lattice. Any passive two-feed, four-feed, or greater radiating elements that fit within array lattice constraints can be driven with the active quadrature combiner.

In at least one embodiment, each radiating element 802 may include via fencing 810 to improve scan performance of the circular microstrip patch array 800 by reducing inter-element mutual coupling.

In at least one embodiment, the circular microstrip patch array 800 is an active electronically scanned array that may be configured for normal "looking straight ahead" with $TM_{11}$ circular microstrip patches 804. Alternatively, it may be configured for "End fire" with $TM_{41}$ monopole-like circular microstrip patches 804.

In at least one embodiment, dynamic element pattern-level adjustment as a function of scan is enabled. The system may produce low angle radiation and analog nulling without increased digital beam forming burden.

Active quadrature feed may be utilized in applications that have been primarily restricted to differential RF integrated circuit driving differential planar dipoles in a wafer-scale, intra-RFIC fashion with wafer integrated radiation elements.

Active quadrature feed-based antennas can be embedded directly into module RF assemblies. The embedded antenna version of a small form factor robust RF System on a Chip (RFSoC) module can be 1st order utilized in many application scenarios. Scalable modules with embedded radiated elements can be utilized in a modular fashion for small form factor UAV and micro-UAV systems. The active quadrature feed's multi-mode capability can be constructed to provide miniature, conformal, and of low visibility operations. The active quadrature feed/antenna assembly can be a miniaturized for surrogate omni-like broad beam broadcast and interrogation for directional RF networks.

In at least one embodiment, active quadrature fed antennas or antenna arrays may be a core component of GPS/GNSS anti-jam beam forming along with additional reconfigurability for COMM and GPS-denied DF systems modes. Analog nulling under severe jammer/signal ratios can be attacked by analog nulling with tunable band stop or band pass filters on each channel/feed, followed by digital beam form nulling Space-Time Adaptive Array Processing (STAAP), etc.

The quadrature fed antenna-based architecture enables an attractive differential/quadrature radiating element for various applications. Quadrature fed antennas array may be directly integrated with RFIC front end of analog/digital and hybrid beamformers, and tight integration to two-feed/four-feed radiating elements without the needs for passive or active BALUNS. This enable a tightly integrated application specific transmit/receive module to the ACT module as a monolithic hardware stack.

Active quadrature feed may enable the practical use of electrically small/low profile radiating elements to realize very pure circular polarization performance on large instantaneous band widths. Furthermore, multi-feed radiating elements may be driven in higher modes to realize end-fire monopole type radiating patterns for enhanced performance near the horizon. Alternatively, active quadrature feed may enable an array wherein a center portion of an array is driven in a first mode while a perimeter portion of an array is driven in a second mode for dynamic pattern shaping.

Active quadrature feed is superior to passive BALUN-based combiner structures in terms instantaneous band width, active gain, and phase and amplitude balance. It is directly compatible with modern differential RF circuitry, precluding the need for active and/or passive BALUNS.

Dynamic adjustment of quadrature fed antenna amplitude/phase/group delay allows for dynamic radiation pattern shaping, including nulls for anti-jamming operation. Active quadrature feed is compatible with high integration of low-noise amplifiers, power amplifier stages, and high-power miniature filter technology for enhanced jammer-to-signal ratios. The extreme miniature size of the active quadrature feed enables the pattern synthesis of omnidirectional radiation patterns by the super position of two radiating elements operating in different modes.

In active electronically scanned arrays, the amplitude/phase/delay adjustment capability allows a dynamic adjustment of the radiating elements radiation pattern as a function of scan, and frequency, etc.

Differential active circuit typologies offer electronic noise immunity and low parasitic impedance for intra-RFIC signal routing.

It is believed that the inventive concepts disclosed herein and many of their attendant advantages will be understood by the foregoing description of embodiments of the inventive concepts disclosed, and it will be apparent that various changes may be made in the form, construction, and arrangement of the components thereof without departing from the broad scope of the inventive concepts disclosed herein or without sacrificing all of their material advantages; and individual features from various embodiments may be combined to arrive at other embodiments. The form herein before described being merely an explanatory embodiment thereof, it is the intention of the following claims to encompass and include such changes. Furthermore, any of the features disclosed in relation to any of the individual embodiments may be incorporated into any other embodiment.

What is claimed is:

1. An antenna comprising:

at least one radiating element comprising at least two feed probes;

at least one differential switch connected to the at least two feed probes; and at least one active quadrature antenna feed element connected to the at least one radiating element, each of the at least one active quadrature antenna feed element comprising at least:

a first, receive channel having one or more amplifiers configured to receive an in-phase ("I") component of a signal and a quadrature ("Q") component of a signal from the at least one radiating element, and a quadrature vector modulator; and a second, transmit channel having an I/Q splitter and one or more amplifiers configured to apply an I component to at least one feed probe of the at least one radiating element and apply a Q component to at least one feed probe of the at least one radiating element.

2. The antenna of claim 1, wherein the at least one radiating element is a helical radiating element.

3. The antenna of claim 1, wherein the at least one radiating element is a dielectric resonator.

4. The antenna of claim 1, wherein the at least one radiating element is a circular microstrip patch.

5. The antenna of claim 4, wherein the first feed probe and second feed probe are disposed 90 degrees apart.

6. The antenna of claim 4, wherein the at least one active quadrature antenna feed element comprises four feed probes, each disposed 90 degrees from a neighboring probe.

7. The antenna of claim 1, wherein the at least one radiating element comprises a dual-orthogonally polarized radiating element.

8. The antenna of claim 7, further comprising an active in phase combiner/splitter connected to the at least one active quadrature antenna feed element, wherein:

the at least one radiating element comprises:

a first radiating element connected to a first active quadrature antenna feed element configured for a first radiating pattern; and a second radiating element connected to a second active quadrature antenna feed element configured for a second radiating pattern; and the active in phase combiner/splitter is configured to superimpose signals to and from the first active quadrature antenna feed element and second active quadrature antenna feed element.

9. A communication system comprising:

an array of radiating elements, each radiating element comprising at least two feed probes;

at least one differential switch connected to the at least two feed probes of each radiating element; and a plurality of active quadrature antenna feed elements, each connected to one radiating element in the array of radiating elements, each active quadrature antenna feed element comprising at least:

a first, receive channel having one or more amplifiers configured to receive an in-phase ("I") component of a signal and a quadrature ("Q") component of a signal from the at least one radiating element, and a quadrature vector modulator; and a second, transmit channel having an I/Q splitter and one or more amplifiers configured to apply an I component to at least one feed probe of the at least one radiating element and apply a Q component to at least one feed probe of the at least one radiating element.

10. The communication system of claim 9, wherein each radiating element is a helical radiating element.

11. The communication system of claim 9, wherein:

the array of radiating elements comprises a first set of radiating elements disposed in a center portion of the array and a second set of radiating elements disposed in a perimeter portion of the array; and the first set of radiating elements are driven in a first mode while the second set of radiating elements are driven in a second mode to produce dynamic beam shaping.

12. The communication system of claim 9, wherein each radiating element is a circular microstrip patch.

13. The communication system of claim 12, wherein each active quadrature antenna feed element comprises four feed probes, each disposed 90 degrees from a neighboring probe.

14. The communication system of claim 9, wherein each radiating element comprises a dual-orthogonally polarized radiating element.

15. The communication system of claim 14, further comprising an active in phase combiner/splitter connected to at least two active quadrature antenna feed elements, wherein:

the array of radiating elements comprises:

a first radiating element connected to a first active quadrature antenna feed element configured for a first radiating pattern; and a second radiating element connected to a second active quadrature antenna feed element configured for a second radiating pattern; and the active in phase combiner/splitter is configured to superimpose signals to and from the first active quadrature antenna feed element and second active quadrature antenna feed element.

* * * * *